United States Patent [19]

Guritz et al.

[11] Patent Number: 4,811,183

[45] Date of Patent: Mar. 7, 1989

[54] TAMPER-RESISTANT FLUORESCENT TUBE ASSEMBLY HOLDER/ADAPTER FOR LAMPS

[76] Inventors: Kenneth E. Guritz, 570 Emerald Harbor Dr., Longboat Key, Fla. 34228; Michael L. Guritz, 7615 9th Avenue Dr. NW., Bradenton, Fla. 33529

[21] Appl. No.: 182,526

[22] Filed: Apr. 18, 1988

[51] Int. Cl.[4] ..... F21V 15/00

[52] U.S. Cl. ..... 362/377; 362/216; 362/260

[58] Field of Search ..... 362/216, 217, 249, 260, 362/344, 353, 377, 378

[56] References Cited

U.S. PATENT DOCUMENTS

| | | | |
|---|---|---|---|
| 3,733,482 | 5/1973 | Miller et al. | 362/216 |
| 3,974,584 | 8/1976 | Shorette | 362/216 X |
| 4,141,061 | 2/1979 | Ford et al. | 362/216 |

*Primary Examiner*—Stephen F. Husar
*Attorney, Agent, or Firm*—Charles J. Prescott

[57] ABSTRACT

A miniature florescent tube assembly holder and adapter for use in conjunction with the original manufacture or retrofit replacement of the conventional incandescent bulb and socket assembly of a lamp. The invention comprises a hollow housing having mating first and second housing portions held together by a tamper-resistant connector. An intermediate plate between first and second housing portions may also be provided to facilitate electrical connection with the lamp and power supply. At least one receptacle is disposed either on the interior of the first housing portion or on one surface of the intermediate plate for receiving the base of the fluorescent tube assembly and effecting electrical connection leading to a power supply. The fluorescent tubes themselves, being slightly smaller in circumference than the base, pass through a mating aperture in the second housing portion and, by this arrangement, each fluorescent tube assembly is trapped and secured within the receptacle and housing to prevent theft. Various means for supporting a lamp shade are also disclosed.

7 Claims, 7 Drawing Sheets

TAMPER-RESISTANT FLUORESCENT TUBE ASSEMBLY HOLDER/ADAPTER FOR LAMPS

BACKGROUND OF THE INVENTION

This invention relates generally to fluorescent lamp lighting devices, and more particularly to a tamper-resistant fluorescent tube assembly holder/adapter for lamps.

Fluorescent lamps, including those miniaturized fluorescent tube assemblies developed and licensed by Norelco Corporation, provide substantial energy saving characteristics over conventional incandescent bulbs used in electric lamps and fixtures. These miniature fluorescent tube assemblies are currently available in single twin-tube configuration rated at 5, 6, 9 and 13 watts and in double twin-tube configuration rated at 9 and 13 watts. Examples of utilization of miniaturized fluorescent tube assemblies and fixtures are shown in U.S. Pat. No. 3,733,482 to Miller and my previous U.S. Pat. No. 4,342,072.

Some attempts have been made to incorporate the benefits of miniaturized fluorescent tube lighting into free standing lamps having sockets adapted to otherwise receive conventional incandescent bulbs. Examples of such adaptations are disclosed in U.S. Pat. No. 4,383,200 to VonZon, et al., and U.S. Pat. No. 4,389,595 to Kamei et al. These inventions are equally functional in mounted fixtures adapted to receive the base of conventional incandescent bulbs.

My own efforts to utilize the Norelco miniaturized fluorescent tube assembly are embodied in the product carrying the trademark LUMEN-AIDER distributed by ElectroDex, Inc., Bradenton, Fla., e.g., P/N LA115P9. This device includes a receptacle for releasably receiving a single fluorescent tube assembly and also includes an encapsulated ballast or transformer adjacent thereto to render the entire assembly completely interchangeable with a conventional incandescent bulb.

One drawback to my above-referenced invention, as well as those above disclosed which are intended to be interchangeable with conventional incandescent lamps is that these devices all incorporate a transformer which adds substantial bulk and weight to these devices. This additional weight, over and above the weight of the fluorescent tube assembly, renders free standing lamp assemblies somewhat top heavy when incorporating such devices.

Many commercial motel and hotel establishments are quite interested in taking advantage of the substantial energy saving features of these miniaturized fluorescent tube assemblies in both mounted fixtures and free standing lamps. However, in addition to the somewhat less stable features of the above devices which incorporate a transformer, none of the devices address the additional drawback of theft of these devices from lamps and fixtures so equipped. This theft problem has arisen because of the substantially increased cost of miniaturized fluorescent tube assemblies and, perhaps by the curious and light-fingered generally. A further commercial requirement relates to the minimum lighting capacity of each lamp.

The present invention provides a holder/adapter for miniaturized fluorescent tube assemblies which facilitates either original manufacture or retrofit assembly to replace the conventional electrical socket which receives the base of an incandescent lamp. This invention then is adapted to receive one or more fluorescent tube assemblies and to render their removal therefrom extremely difficult, if not impossible, without specialized tools or equipment. By providing for receiving a plurality of fluorescent tube assemblies, this invention also conveniently facilitates multi-light intensity function which is desirable both aesthetically and, furthermore to provide the necessary minimum light output which is not presently achievable by only one of the Norelco miniaturized fluorescent tube assemblies. Accommodation for lamp shade connection and support is also provided.

BRIEF SUMMARY OF THE INVENTION

This invention is directed to a miniature fluorescent tube assembly holder and adapter for use in conjunction with the original manufacture or retrofit replacement of the conventional incandescent bulb and socket assembly of a lamp. The invention comprises a hollow housing having mating first and second housing portions held together by a tamper-resistant connector. An intermediate plate between first and second housing portions may also be provided to facilitate electrical connection with the lamp and power supply. At least one receptacle is disposed either on the interior of the first housing portion or on one surface of the intermediate plate for receiving the base of the fluorescent tube assembly and effecting electrical connection leading to a power supply. The fluorescent tubes themselves, being slightly smaller in circumference than the base, pass through a mating aperture in the second housing portion and, by this arrangement, each fluorescent tube assembly is trapped and secured within the receptacle and housing to prevent theft. Lamp shade support means are also provided.

It is therefore an object of this invention to provide a holder/adapter connectable to free standing lamps which operably receives at least one miniaturized fluorescent tube assembly for use and which prohibits the removal of the tube assembly therefrom without specialized tools and equipment.

It is another object of the above invention to be incorporated into original manufactured lamps and fixed mount fixtures as well as to be retrofitted thereto to replace conventional incandescent lamp sockets.

It is yet another object of this invention to provide multi-light level fluorescent tube assembly lighting in conjunction with free standing lamps and fixed-mounted fixtures.

It is yet another object of the above invention to incorporate structure adapted to receive conventional lamp shade supporting devices such as harps.

It is yet another object of the above invention to also provide various lamp shade supports including a telescoping, upwardly adjustable lamp shade support tube assembly.

In accordance with these and other objects which will become apparent hereinafter, the instant invention will now be described with reference to the accompanying drawings in which:

DETAILED DESCRIPTION OF THE INVENTION

Figure 1:
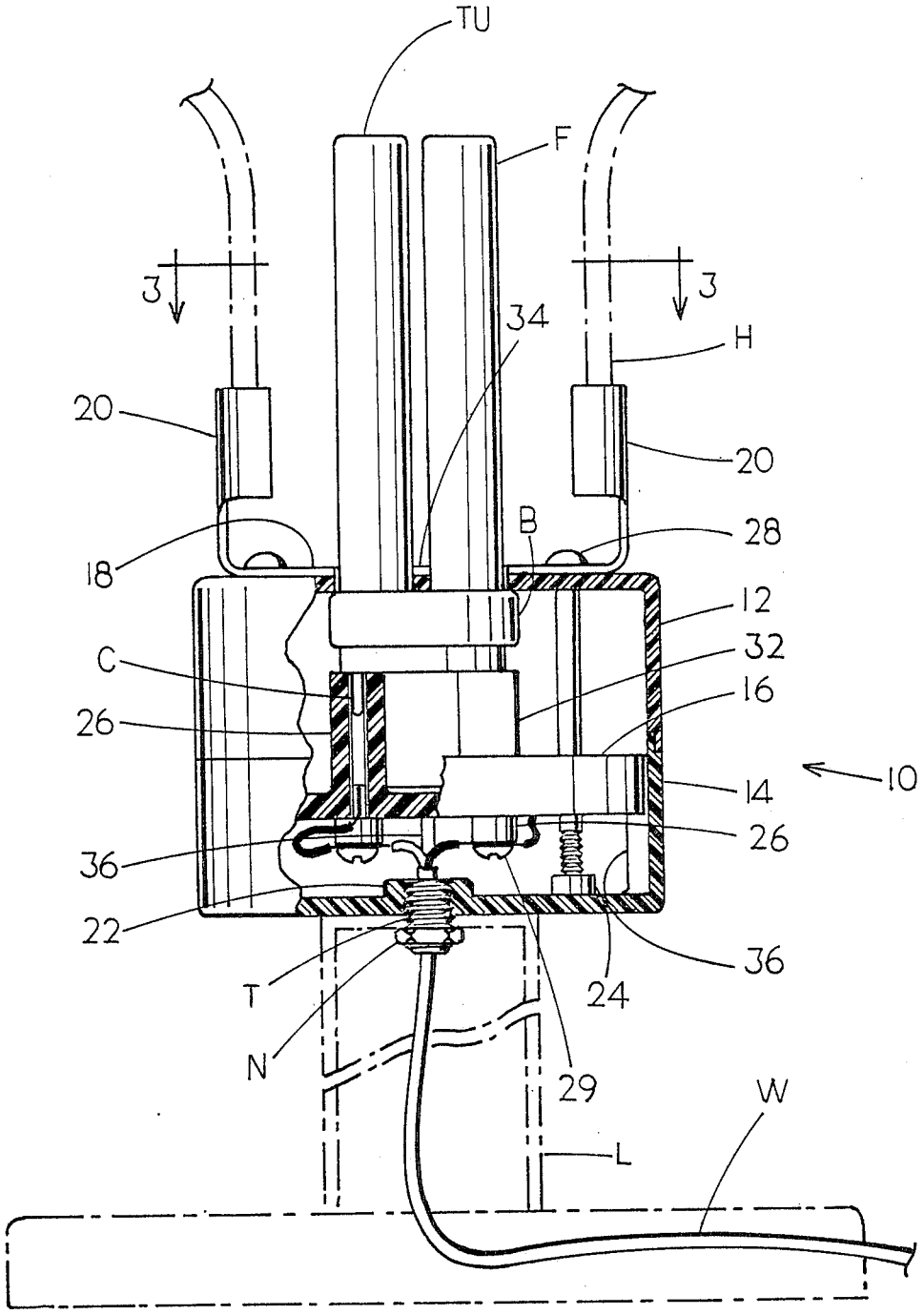
FIG. 1 is a side elevation broken section view of one embodiment of the invention depicting a lamp and harp for supporting a lamp shade shown in phantom.
Figure 3:
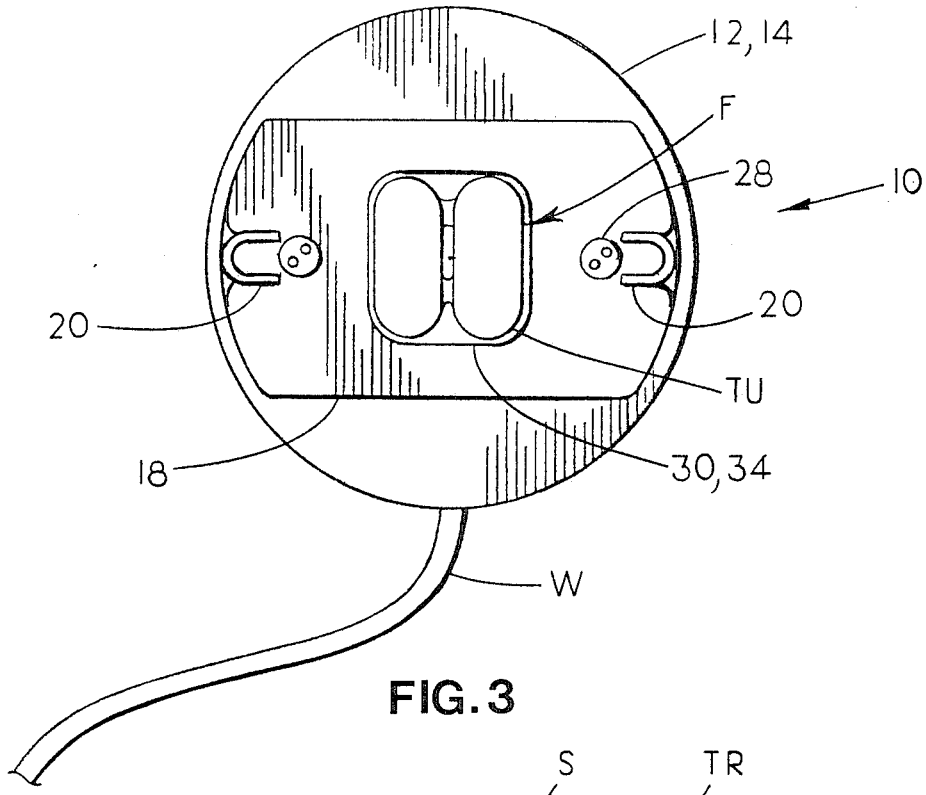
FIG. 3 is a view in the direction of arrows 3—3 in FIG. 1.

Referring now to the drawings, and particularly to FIGS. 1 and 3, one embodiment of the invention is shown generally at 10 and includes an upper housing 12 and a lower housing 14 which mateably engage one to another as shown. These upper and lower housings 12 and 14 are molded of thin-wall glass-filled plastic. Disposed and secured within the upper and lower housing 12 and 14 is intermediate plate 16 made of similar material and which is secured in position when threaded fasteners 28 are secured into bosses 24 as shown. Ribs 36, integral with the lower housing 14, position and support the intermediate plate 16.

Upwardly extending from intermediate plate 16 is receptacle 32 which is adapted to supportively receive the base B of fluorescent tube assembly F. Embedded within receptacle are electrical contacts 26 in electrical communication with wire W. Base B includes contacts C which mateably engage into tubular contacts 26 to operably connect the fluorescent tube assembly F to a ballast or transformer and a power supply (not shown).

Once base B is securely positioned within receptacle 32, upper housing 12 having aperture 30 is positioned around the connected fluorescent tubes TU and, because the perimeter of the fluorescent tubes TU is slightly smaller than that of the base B, the fluorescent tube assembly F is securely trapped within receptacle 32 when threaded fasteners 28 are in place and securely engaged. To facilitate insuring that the base B may not be disengaged from receptacle 32, the vertical dimensions between ribs 36, the intermediate plate 16, and the inner surface of upper housing 12 are accurately controlled.

Because the driving heads of threaded fasteners 28 are chosen to only accept specialized tools, that is, being of a "tamper-resistant" nature, once the above-described components are assembled around the fluorescent tube assembly F within base 32, removal therefrom is virtually impossible without destroying one or more of these components or fluorescent tube assembly F.

In this embodiment 10, the fluorescent tube assembly F shown is generally referred to as a double twin tube fluorescent lamp as, for example, distributed by Osram, P/N 13W Double Dulux. This assembly has a single power characteristic and is rated at from 5 to 13 watts as currently available.

Disposed centrally in the bottom of lower housing 14 is boss 22 having internal threads which mateably engage with a conventional length of hollow externally threaded tube T which, by nut N is secured to lamp L as shown.

Because most lamp are aesthetically more pleasing having a lamp shade which must be supported above the lamp L typically by a harp H, a lamp shade support plate 18 is also provided which is retained in place by threaded fasteners 28 atop the upper housing 12 as shown. This lamp shade support plate 18 includes aperture 34 which registers and aligns with aperture 30 in upper housing 12 around fluorescent tubes TU. The well known structure of harp H may then be squeezed together and then released when in alignment and registry with mateing brackets 20, integral with and upwardly extending on plate 18.

Figure 4:
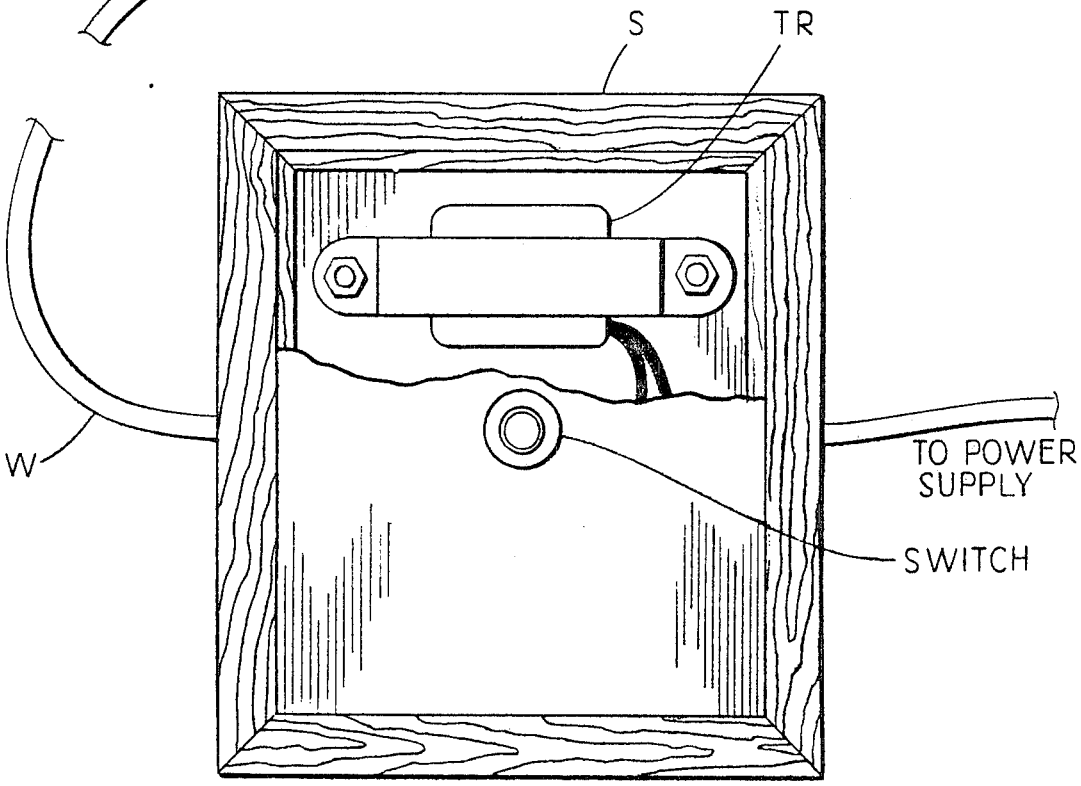
FIG. 4 is a top plan broken view of a separate decorative housing for containing the ballast or transformer and control switch.

Referring additionally to FIG. 4, all fluorescent tubes require a transformer TR to modify the electrical characteristic of conventional power supplies. Because these transformers TR are somewhat heavy and bulky, a separate switch box S, having an on/off switch and interconnectable to the power supply, is also provided. This arrangement facilitates retrofit installations. Alternately, although not shown, these transformers TR may be mounted within the lamp L itself. However, because one particular use for the invention resides in the conversion of existing incandescent lamp-type lamps to utilize fluorescent tube assemblies F, a switch box S having transformer TR mounted therein facilitates this conversion. Further in the converting process, the existing lamp socket (not shown) which is adapted to receive the base of a conventional incandescent lamp may be easily removed, leaving tube T exposed above the upper end of lamp L for easy and convenient threaded engagement into the boss 22 of lower housing 14.

Figure 2:
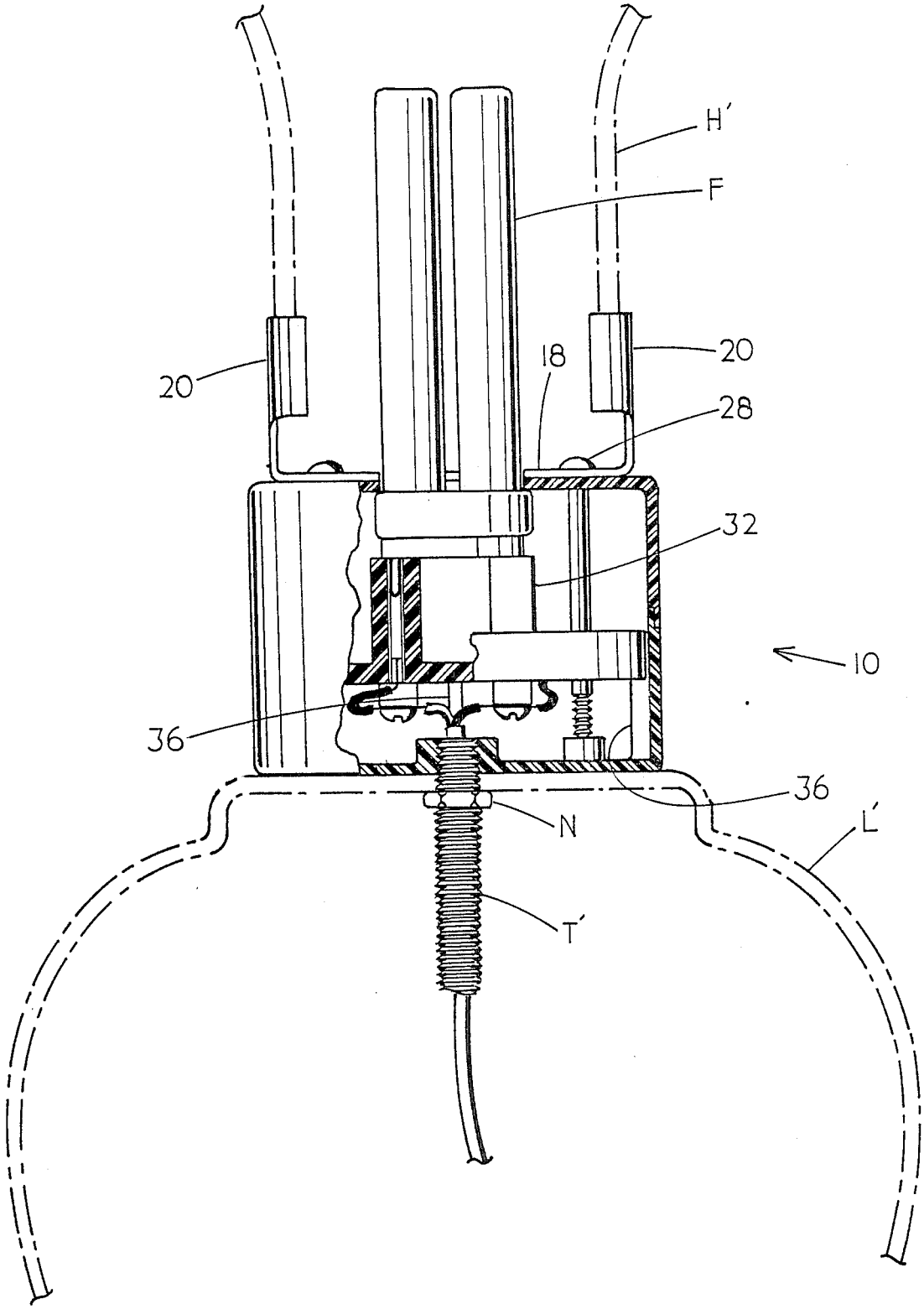
FIG. 2 is a view similar to FIG. 1 depicting an alternate shape of the lamp and harp.

Referring now to FIG. 2, the same embodiment of the invention as previously described with regard to FIG. 1 is shown generally at 10 attached and interconnected by threaded tube T′ and nut N atop lamp L′ having a distinctively different external ornamental configuration as shown in phantom. The only other difference depicted in FIG. 2 from FIG. 1 is that an alternate embodiment of harp H′ is shown to depict that lamp shade support 20 and the invention, generally, is readily adaptable to virtually all configurations of harps H or H′.

Figure 5:
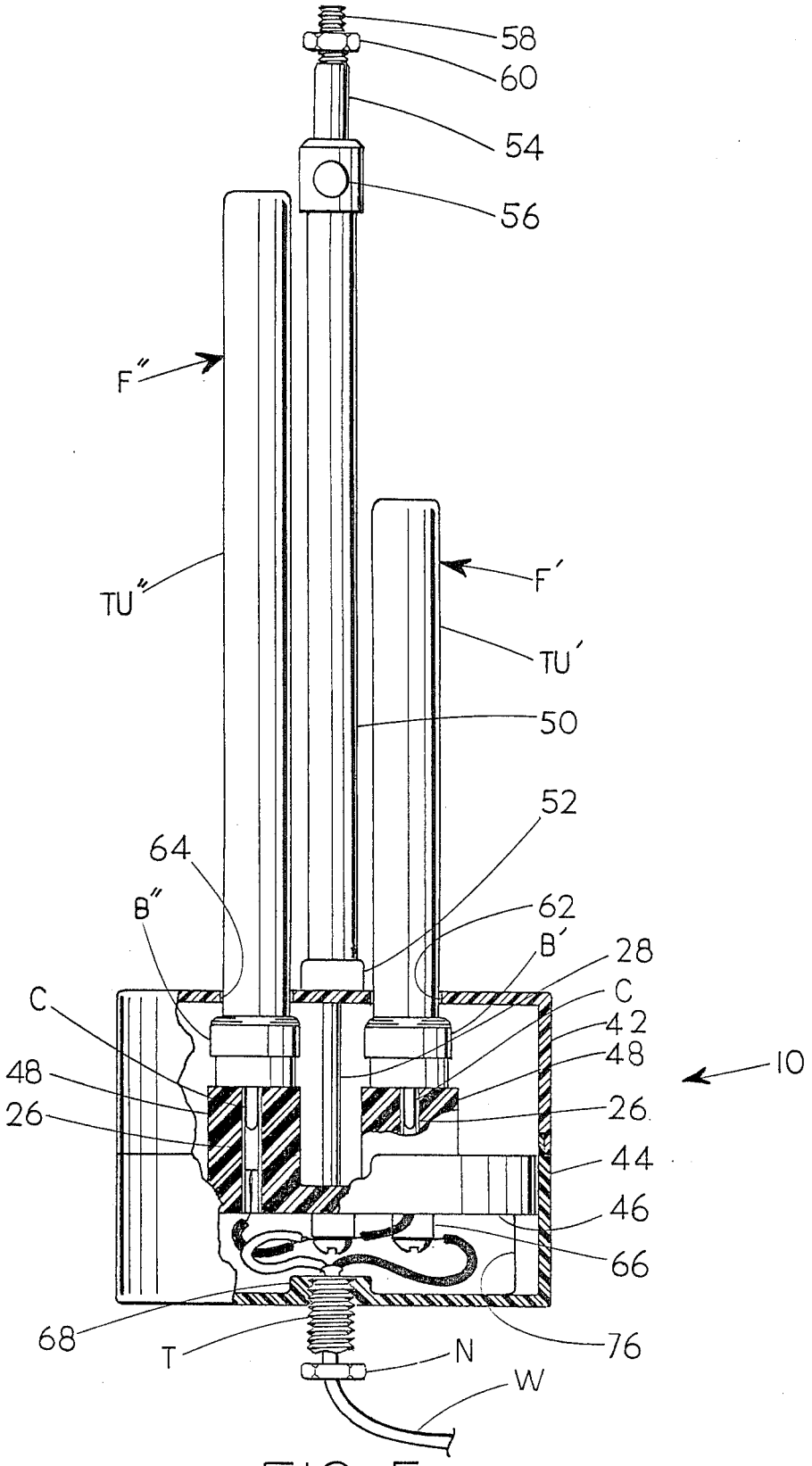
FIG. 5 is a side elevation broken section view of the preferred embodiment of the invention.
Figure 7:
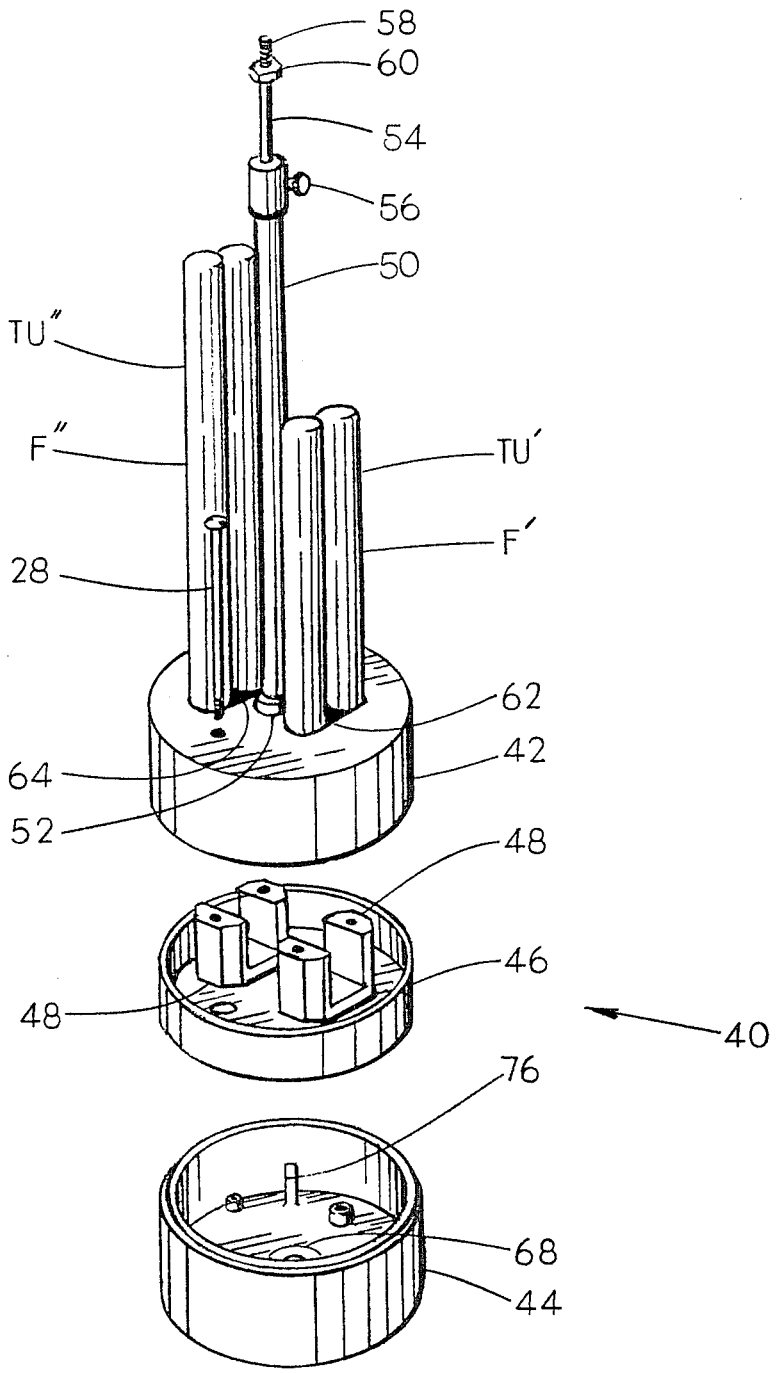
FIG. 7 is an exploded perspective view of the preferred embodiment of the invention as shown in FIG. 5.

Referring now to FIGS. 5 and 7, the preferred embodiment of the invention is shown generally at 40 and includes upper housing 42 and lower housing 44 mateably engageable and securing therein intermediate plate 46, retained thusly by threaded fasteners 28. Intermediate plate 46 includes two separate receptacles 48 which are adapted, as previously described, to receive the bases B′ and B″ of fluorescent tube assemblies F′ and F″.

Because fluorescent tube assemblies F′ and F″ are chosen to be of different power intensity, the wiring W interconnected to the appropriate transformers and switch (not shown) facilitate a three way operation similar to conventional three way incandescent lamps. Either fluorescent tube F′ or F″ may be independently activated or both may be simultaneously activated to provide three way light intensity. This arrangement also carries the additional benefit of providing sufficient power by combination of activating both fluorescent tube assemblies F′ and F″ to illuminate at a certain minimum level as required by some commercial institutions. As noted earlier, only fluorescent tube assemblies of up to 13 watts are presently available and practical to manufacture.

Apertures 62 and 64 are, as previously described, sized to just fit around the perimeter of fluorescent tube TU' and TU" so as to trap the enlarged bases B' and B" within receptacles 48. Again, tamper-resistant threaded fasteners 28, when engaged, render the fluorescent tube assemblies F' and F" relatively theft proof when the entire assembly 40 is interengaged by hollow threaded tube T' and nut N atop a lamp (not shown).

In the preferred embodiment 40, a centrally located upwardly extending lamp shade support in the form of telescoping mateing rigid inner and outer tubes 54 and 50 respectively are provided. Outer tube 50 is threadably engageable into boss 52 centrally positioned in upper housing 42. Inner telescoping tube 54 includes threads 58 at its upper distal end and is lockably engageable into the well-known structure of lamp shades to secure the lamp shade thereto. By the telescoping feature, lockably positionable at any desired vertical height position by thumb screw 56, this preferred embodiment of the lamp shade support is easily adaptable to almost any height and shape lamp shade, disposing of the conventional harp H or H' (not here shown) to be included in a retrofit situation.

Figure 6:
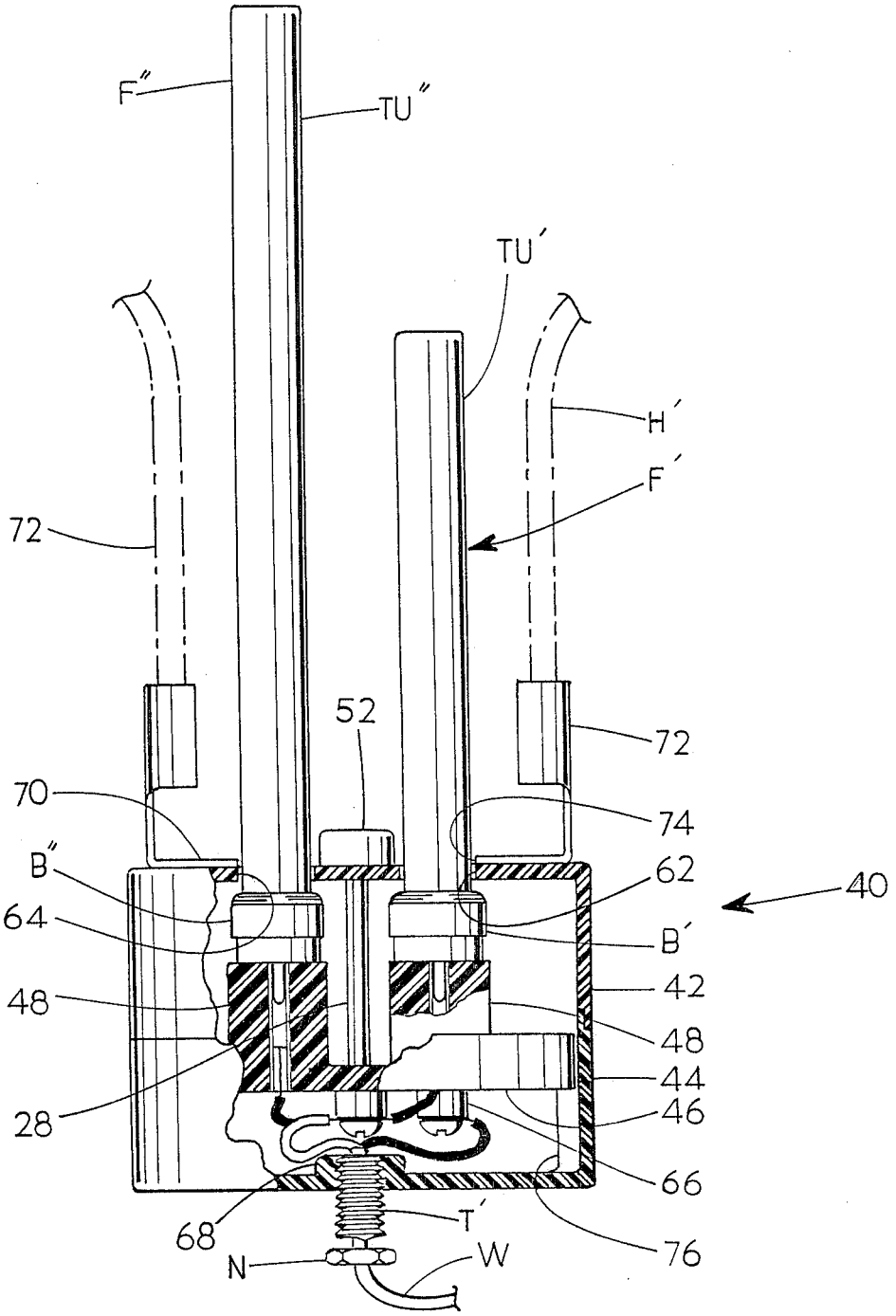
FIG. 6 is a side elevation broken section view of yet another embodiment of the invention depicting another harp for supporting a lamp shade shown in phantom.

Referring now to FIG. 6, another embodiment of the lamp shade support plate 70 is there shown in conjunction with the preferred embodiment 40 of the invention. All of the structure and detail with regard to the holder-/adapter 40 is identical to that previously described with respect to FIG. 5. However, in this embodiment, the upwardly extending telescoping lamp shade support has been replaced with a conventional harp H' shown in phantom which is supportively receivable into brackets 72 integral with plate 70 which is attached atop the upper housing 42 by threaded fasteners 28. Aperture 74 is provided in plate 70 to fit completely around the perimeter of both fluorescent tube assemblies F' and F".

Figure 8:
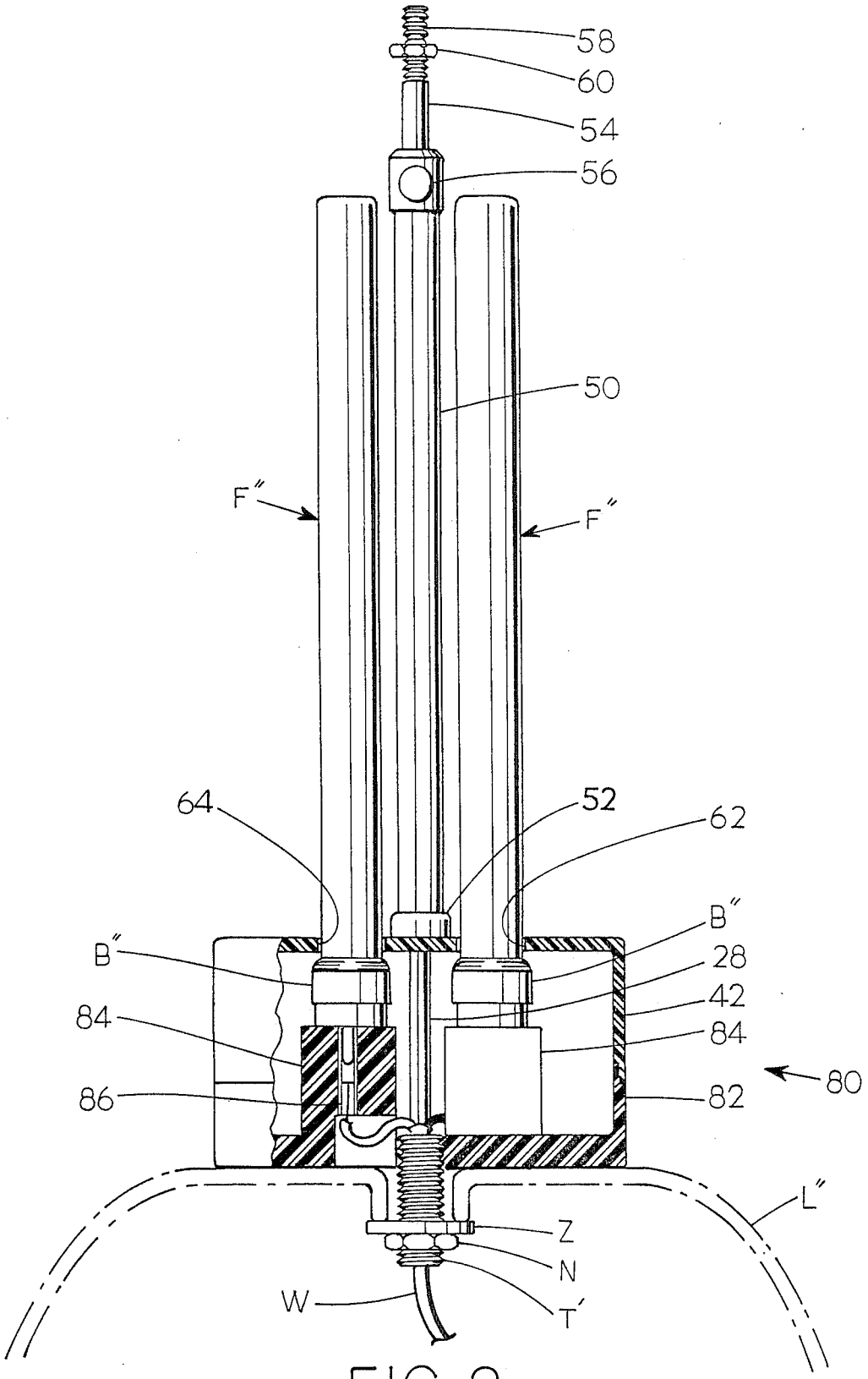
FIG. 8 is a side elevation broken section view of another embodiment of the invention, including the preferred embodiment for the lamp shade support and depicting another lamp shown in phantom.

Referring lastly to FIG. 8, another embodiment of the invention is shown generally at 80 adapted to supportively receive two separate fluorescent tube assemblies F' (here shown identical in size). This embodiment 80 includes the same upper housing 42 as previously described with respect to FIGS. 5 to 7; however, the intermediate plate 46 previously described therein has been eliminated. The receptacles 84 are formed integral with the bottom housing 82 which via electrical contacts 86 are in electrical communication via wire W with the bases B' of the fluorescent tubes F".

By externally threaded tube T', the lower housing 82 is interengaged atop lamp L' having a centrally positioned formed aperture to receive the threaded tube T' and securable between washer Z, nut N and the bottom surface of the lower housing 82.

This embodiment, as previously described, includes upwardly extendable telescoping inner and outer lamp shade support tubes 54 and 50 respectively interengageable by boss 52 to the center of upper housing 42. Likewise, apertures 62 and 64 trap the fluorescent tube assemblies F" within receptacles 84 as previously described.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A miniature fluorescent tube assembly holder and adapter for an electric lamp comprising:
   a rigid, generally hollow housing supportably connectable to the lamp and having mating first and second housing portions;
   a tamper-resistant connector operably disposed between and for securably interconnecting said first and second housing portions when engaged;
   said first housing portion including at least one fluorescent tube assembly receptacle for supportively receiving and operably connecting the base of the fluorescent tube assembly to a transformer and electric power supply;
   said second housing portion including at least one aperture each in alignment with one said receptacle and adapted to allow the elongated fluorescent tubes of the fluorescent tube assembly to pass therethrough, but to prevent the enlarged base of the fluorescent tube assembly from passing therethrough whereby each fluorescent tube assembly is trapped and secured within said housing when said tamper-resistant connector is engaged.

2. A miniature fluorescent tube assembly holder and adapter as set forth in claim 1, further comprising:
   a lamp shade support connector connectable to said housing and adapted to supportively receive a lamp shade support.

3. A miniature fluorescent tube assembly holder and adapter as set forth in claim 1, further comprising:
   an elongated, rigid, upwardly extendable lamp shade support threadably engageable at its lower end into said housing and adapted at its upper end to supportively receive and releasably secure a lamp shade thereto.

4. A miniature fluorescent tube assembly holder and adapter as set forth in claim 1, wherein:
   said first housing portion includes two said receptacles;
   said second housing portion includes two said apertures;
   each of said receptacles alternately and jointly connectable selectively to a transformer and an electric power supply.

5. A miniature fluorescent tube assembly holder and adapter as set forth in claim 4, further comprising:
   an intermediate plate securely disposed between said first and second housing portions when said tamper-resistant connector is engaged;
   said receptacles formed into one surface of said intermediate plate.

6. A miniature fluorescent tube assembly holder and adapter as set forth in claim 5, wherein:
   said intermediate plate includes intermediate terminals electrically connected to the fluorescent tube assembly base, said terminals electrically connectable to the transformer and electric power supply.

7. A miniature fluorescent tube assembly holder and adapter for an electric lamp comprising:
   a rigid, generally hollow housing supportably connectable to the lamp and having mating upper and lower housing portions;
   a tamper-resistant connector operably disposed between and for releasably interconnecting said upper and lower housing portions when engaged;
   an intermediate plate securely disposed between said upper and lower housing portions when said tamper-resistant connector is engaged;

said intermediate plate including two fluorescent tube assembly receptacles each for supportively receiving and operably connecting each fluorescent tube assembly base to a transformer and an electric power supply;

said upper housing portion including two apertures each in alignment with one said receptacle and adapted to allow the elongated fluorescent tube of one fluorescent tube assembly to pass therethrough, but to prevent the enlarged base of the fluorescent tube assembly from passing therethrough, whereby each fluorescent tube assembly is trapped and secured within said housing when said tamper-resistant connector is engaged.

* * * * *